US007154230B2

(12) United States Patent
Peka

(10) Patent No.: US 7,154,230 B2
(45) Date of Patent: Dec. 26, 2006

(54) CIRCUIT ARRANGEMENT FOR DIMMING AT LEAST ONE LAMP

(75) Inventor: Petr Peka, Traunreut (DE)

(73) Assignee: Patent-Treuhand-Gesellschaft fur Elektrisch Gluhlampen mbH (DE)

( * ) Notice: Subject to any disclaimer, the term of this patent is extended or adjusted under 35 U.S.C. 154(b) by 0 days.

(21) Appl. No.: 11/204,154

(22) Filed: Aug. 16, 2005

(65) Prior Publication Data

US 2006/0049772 A1 Mar. 9, 2006

(30) Foreign Application Priority Data

Sep. 3, 2004 (DE) ..... 10 2004 042 771

(51) Int. Cl.
*H05B 37/02* (2006.01)

(52) U.S. Cl. ..... 315/209 R; 315/246; 315/DIG. 4

(58) Field of Classification Search ..... 315/209 R, 315/246, DIG. 4, 291, 307, 224, DIG. 7, 315/225

See application file for complete search history.

(56) References Cited

U.S. PATENT DOCUMENTS 6,545,431 B1 * 4/2003 Hui et al. ..... 315/209 R
6,597,127 B1 * 7/2003 Takahashi et al. ..... 315/224
7,075,251 B1 * 7/2006 Chen et al. ..... 315/291

* cited by examiner

*Primary Examiner*—Tuyet Vo
*Assistant Examiner*—Ephrem Alemu
(74) *Attorney, Agent, or Firm*—Fitch, Even, Tabin & Flannery

(57) ABSTRACT

A method and circuit arrangement for dimming at least one lamp, includes a connection for a supply voltage; a dimming device connected on the input side to the supply voltage and has an input for a dimming selection and at least one switch; and a filter connected to the output of the dimming device, the filter having at least one capacitor and an output for coupling to an electronic ballast; wherein it also has an input impedance modification device connected to the filter device and is designed to modify the input impedance active at the input of the filter.

10 Claims, 6 Drawing Sheets

CIRCUIT ARRANGEMENT FOR DIMMING AT LEAST ONE LAMP

This application claims the benefit of Germany patent application No. 102004042771,2 filed Sep. 3, 2004.

FIELD OF THE INVENTION

The present invention relates to a circuit arrangement for dimming at least one lamp, comprising a connection for a supply voltage, a dimming device that is connected on the input side to the connection for the supply voltage and has an input for a dimming selection and at least one switch, and a filter device that is connected to the output of the dimming device, the filter device having at least one capacitor and an output for coupling to an electronic ballast. It relates, moreover, to a method for dimming at least one lamp in the case of which a signal to a filter device is provided with the aid of a dimming device that is connected to a supply voltage, and wherein the filter device has at least one capacitor and an output for coupling to an electronic ballast for the lamp.

BACKGROUND OF THE INVENTION

Such a method and such a circuit arrangement are known, the latter being illustrated schematically in FIG. 1. On the input side, the supply voltage $U_e$, for example the system voltage, is present at a dimming device 10 that has an input 8 for a dimming selection and preferably includes a triac or a thyristor. Following thereupon is a filter device 12 that contains two independent filter inductors L1, L2 and two capacitors C1, C2. In this case, it also has a rectifier circuit 14 that comprises the diodes D1 to D4. Following thereupon is a step-up converter 16 that comprises an inductor L3, a diode D5, a capacitor C3, a resistor R2 and a switch S1. Provided at the output of the step-up converter 16 is the so-called intermediate circuit voltage $U_{zw}$ that is coupled to the input of an electronic ballast. For the following reasons, the embodiment illustrated in FIG. 1 is suitable only for a specific system voltage, for example 120 V or 277 V, depending on the dimensioning of the filter device 12. Specifically, if the dimming device 10 is fitted with a triac or a thyristor, the input impedance of the downstream filter device 12 is to behave in a fashion similar to a resistive load. If the load is not resistive, undesired effects occur or the circuit arrangement no longer functions at all. The optimum values for the inductors L1 and L2, as well as for the capacitors C1 and C2 of the filter device 12 differ in the case of dimensioning for 120 V from those in the case of dimensioning for 277 V.

FIG. 2 shows the time profile of the current $I_{L1}$ through the inductor L1, of the voltage $U_1$ dropping at the output of the dimming device 10, and the voltage $U_{C2}$, which drops at the capacitor C2, in each case for operation of a circuit arrangement dimensioned to 120 V in accordance with FIG. 1, and operation with 120 V. Disregarding small overshoots, FIG. 2 shows the optimum profile of these variables. If the circuit arrangement according to FIG. 1 and dimensioned to 120 V is now operated with 277 V, short large current peaks are produced at the rising edge of the input voltage—see FIG. 3. The behavior of the filter device 12 is then capacitive and an interruption of the input current already occurs after a short time, approximately 100 to 300 μs, since said input current vanishes because of the oscillation behavior. As a result, the current $I_{L1}$ sinks below the holding current threshold of the triac or of the thyristor in the dimming device 10, and the dimming device 10 switches off.

FIG. 4 shows the time profile of the variables $I_{L1}$, $U_1$, $U_{C2}$ in the case of dimensioning of the circuit arrangement in accordance with FIG. 1 for 277 V and operated with an input voltage $U_e$ of 120 V. A high-frequency oscillation is set up that likewise leads to a result of no use.

SUMMARY OF THE INVENTION

The object of the present invention therefore consists in developing the circuit arrangement named at the beginning or the method named at the beginning in such a way as to enable operation at different supply voltages.

The present invention is based on the finding that the known circuit arrangement can be used for different supply voltages whenever it is ensured that the triac or the thyristor of the dimming device sees a virtually resistive load even for different input voltages, that is to say the input impedance of the filter device is virtually resistive. It is therefore provided according to the invention to supplement the generic circuit arrangement by an input impedance modification device that is connected to the filter device and is designed to modify the input impedance active at the input of the filter device, in particular in the direction of resistive behavior. It is possible by means of this measure to render the input impedance of the filter device essentially or at least sufficiently resistive independently of the supply voltage.

The input impedance modification device is preferably designed to modify the capacitive component of the input impedance of the filter device. Of course, the present invention also comprises, however, embodiments in the case of which the inductive component of the input impedance, or the inductive and capacitive components of the input impedance are modified.

In a preferred embodiment, the input impedance modification device is designed to switch at least one further capacitor in parallel or series with the at least one capacitor of the filter device.

The input impedance modification device is designed with particular preference to modify the input impedance active at the input of the filter device as a function of the supply voltage, in particular of the amplitude of the supply voltage. For this purpose, the input impedance modification device has an input that is connected to a signal that is correlated with the supply voltage. This enables an automatic modification of the input impedance of the filter device as a function of the supply voltage.

Further preferred embodiments follow from the subclaims.

BRIEF DESCRIPTION OF THE DRAWINGS

An exemplary embodiment of the invention will now be explained in more detail below with reference to the attached drawings, in which:

FIG. 7 shows the time profile of the variables $I_{L1}$, $U_1$ and $U_{C2}$ from FIG. 5 for a dimensioning of the circuit arrangement to 277 V and operation with a supply voltage of 120 V and with the capacitor C4 switched in.

DETAILED DESCRIPTION OF THE INVENTION

The reference symbols introduced with reference to FIG. 1 continue to be used below for describing the circuit arrangement according to the invention to the extent that they relate to identical and identically acting elements. These are therefore not described again.

Figure 5:
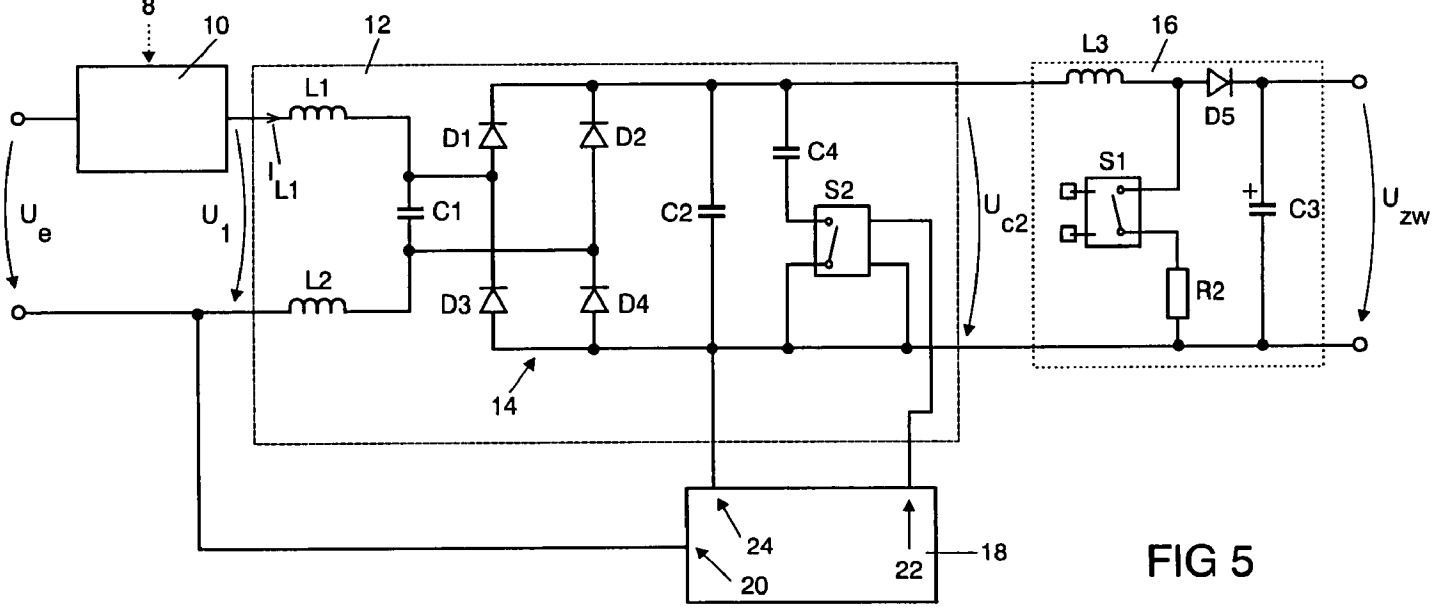
FIG. 5 shows a schematic of an inventive circuit arrangement for dimming at least one lamp.
Figure 2:
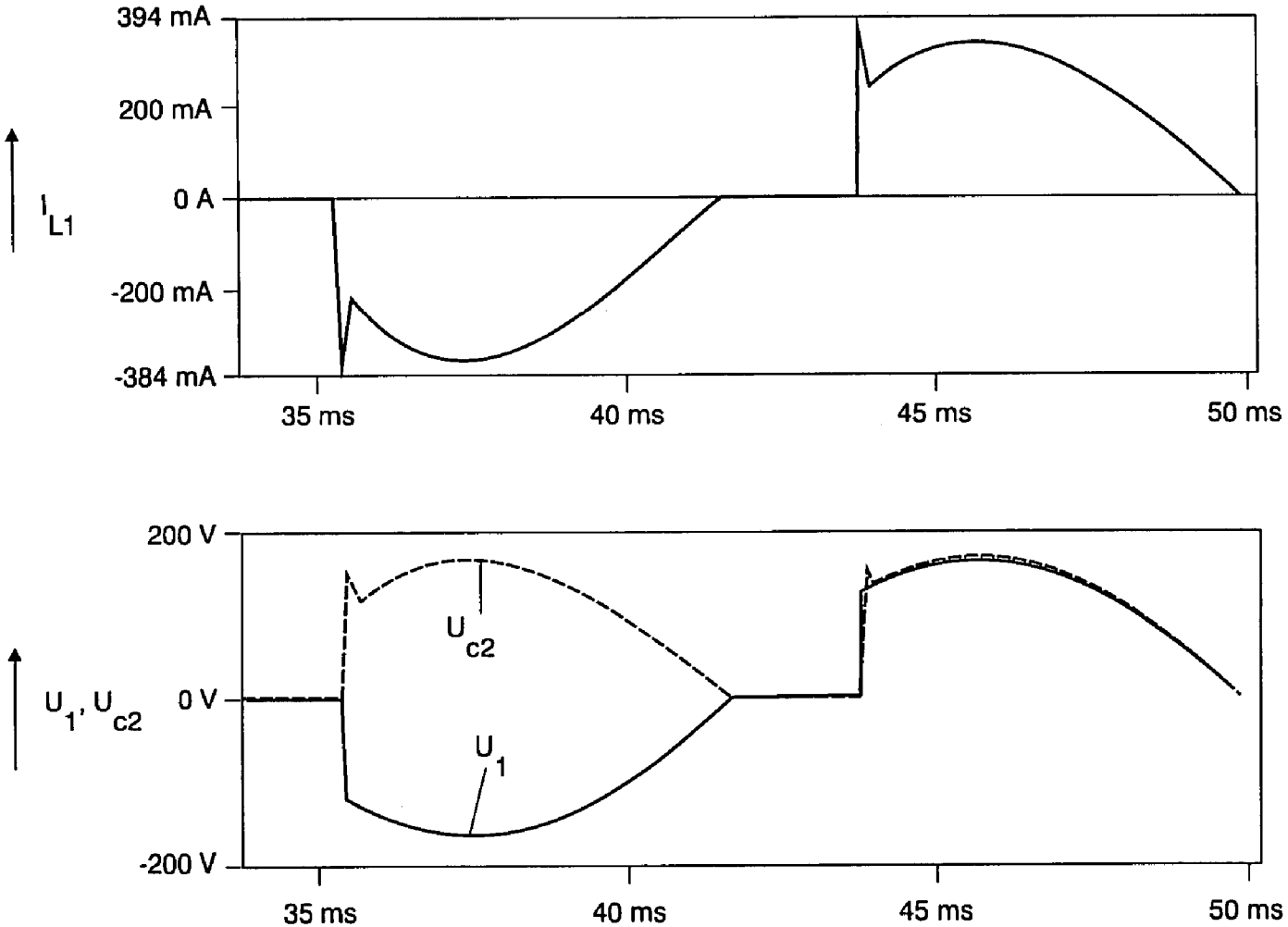
FIG. 2 shows the time profile of the variables $I_{L1}$, $U_1$ and $U_{C2}$ of FIG. 1 for a dimensioning of the circuit arrangement to 120 V and operation with a supply voltage of 120 V.
Figure 3:
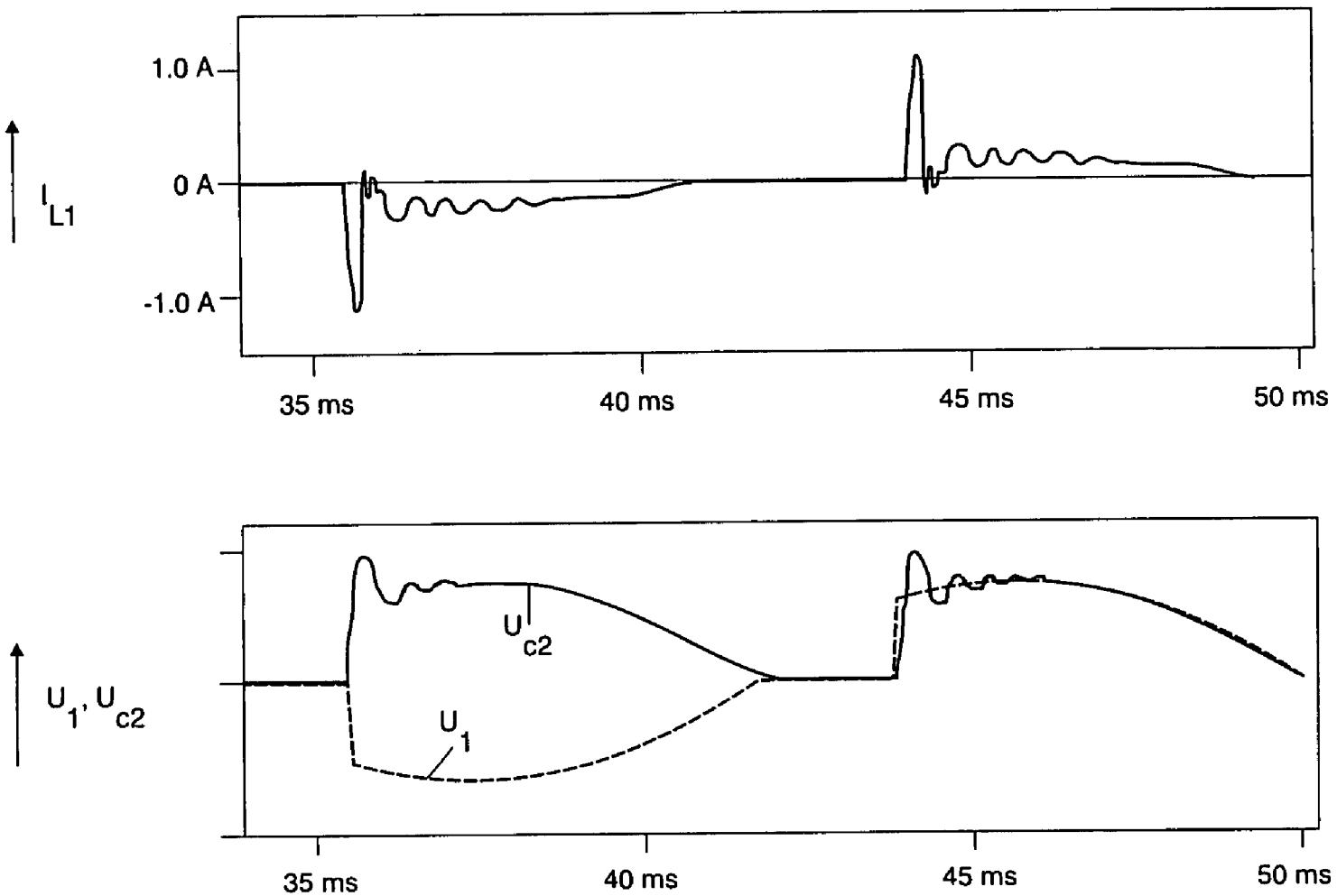
FIG. 3 shows the time profile of the variables $I_{L1}$, $U_1$ and $U_{C2}$ of FIG. 1 for a dimensioning of the circuit arrangement to 120 V and operation with a supply voltage of 277 V.
Figure 4:
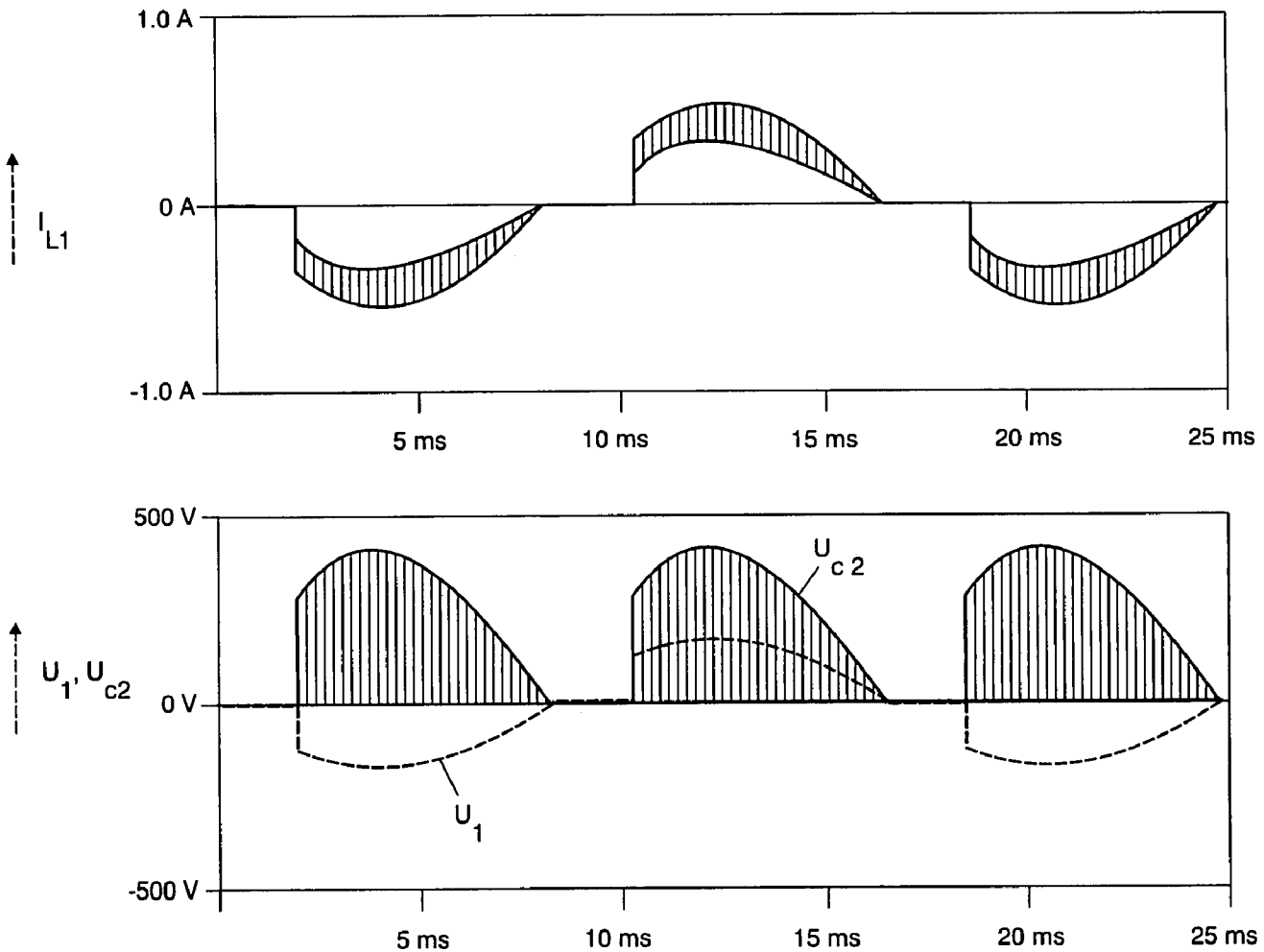
FIG. 4 shows the time profile of the variables $I_{L1}$, $U_1$ and $U_{C2}$ of FIG. 1 for a dimensioning of the circuit arrangement to 277 V and operation with a supply voltage of 120 V.

FIG. 5 has an input impedance modification device 18 that is fed at its input 20 with a signal that is correlated with the input or supply voltage $U_e$. The input impedance modification device is designed to determine the amplitude of the input voltage $U_e$ and, as a function thereof, to provide the switch S2 at its output 22 with a switching signal so as to connect the capacitor C4 in parallel with the capacitor C2, or to deactivate the capacitor C4 by switching it off. The input impedance modification device 18 is, in particular, designed such that for a low input voltage $U_e$ the capacitor C4 is connected in parallel to the capacitor C2, while for a high input voltage $U_e$ the capacitor C4 is deactivated by being switched off such that only the capacitor C2 is active. The input impedance modification device 18 is connected to a frame via the input 24. Measures for measuring the amplitude of a voltage, and for initiating a switching operation as a function of the measured amplitude are sufficiently known to the person skilled in the art and are therefore not described in more detail at this juncture.

Figure 6:
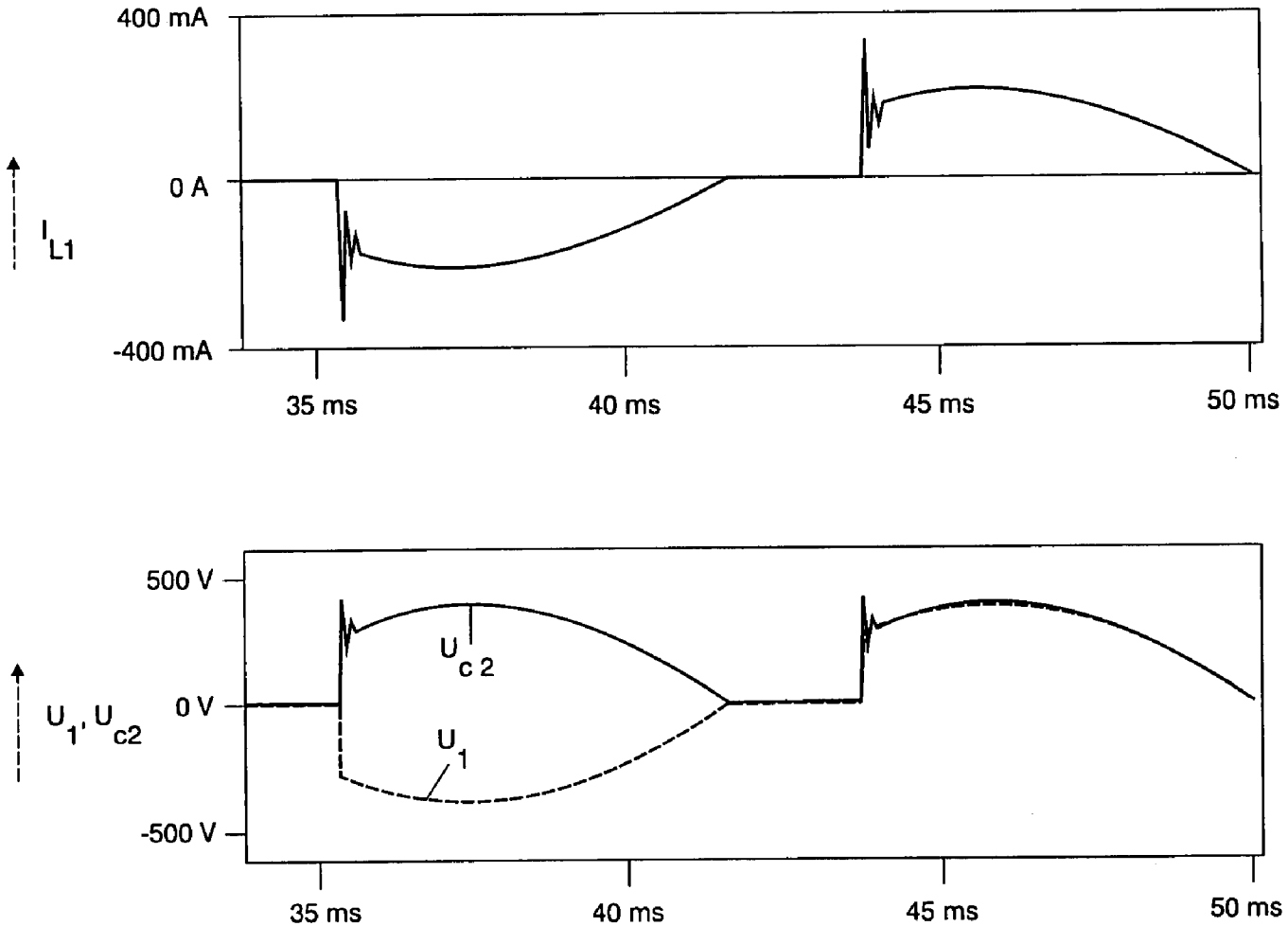
FIG. 6 shows the time profile of the variables $I_{L1}$, $U_1$ and $U_{C2}$ from FIG. 5 for a dimensioning of the circuit arrangement to 277 V and operation with a supply voltage of 277 V.

FIG. 6 shows the time profile of the variables $I_{L1}$, $U_1$, $U_{C1}$ for a dimensioning of the circuit arrangement in accordance with FIG. 5 to 277 V and operation with 277 V. In this case, only the capacitor C2 is active, the capacitor C4 being switched off.

Figure 7:
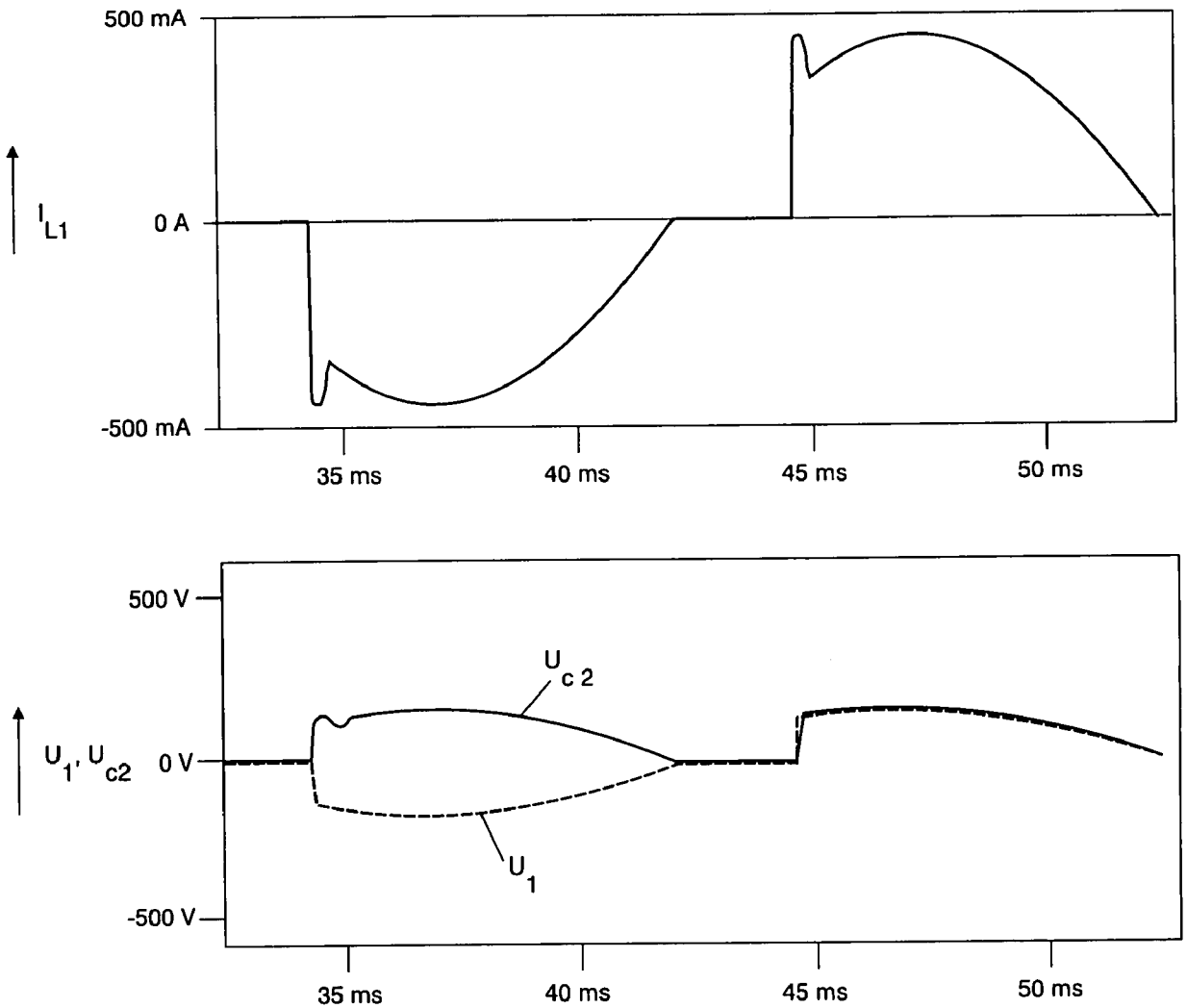

FIG. 7 shows the time profile of the variables $I_{L1}$, $U_1$, $U_{C1}$ for the circuit arrangement dimensioned to 277 V, this time, however, the capacitor C4 being switched in, that is to say being connected in parallel with the capacitor C2, and the circuit arrangement being operated with a supply voltage $U_e$ of 120 V.

Figure 1:
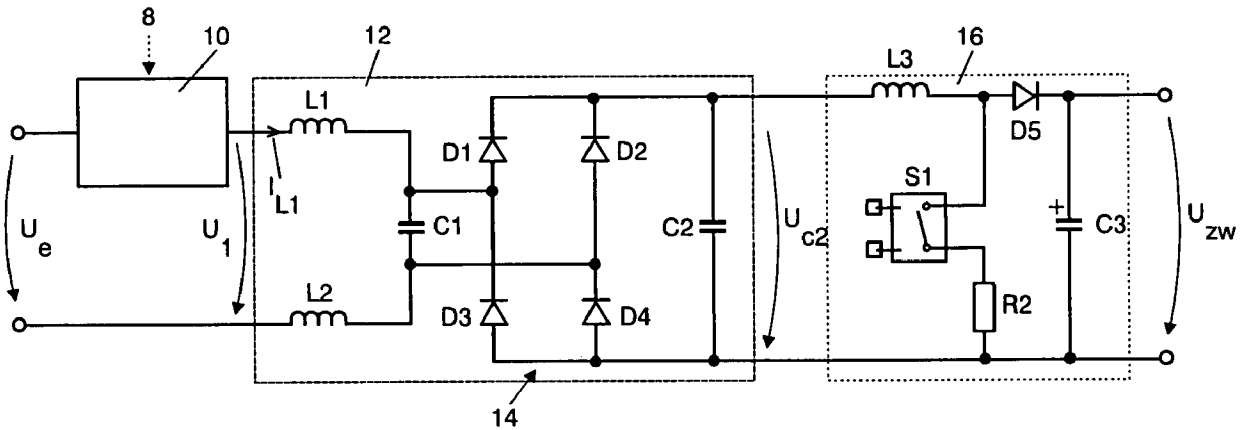
FIG. 1 shows a schematic of a circuit arrangement, known from the prior art, for dimming at least one lamp.

It may be pointed out that in the case of the dimensioning of the circuit arrangement in accordance with FIG. 5 for setting up the profiles in accordance with FIGS. 6 and 7, by comparison with the dimensioning of a circuit arrangement in accordance with FIG. 1 the inductors L1 and L2 correspond neither to the values of the dimensioning of the circuit arrangement of FIG. 1 for 120 V nor to a dimensioning for 277 V, but are preferably selected therebetween. However, this is not a necessity. Rather, the measure according to the invention can ensure the functioning for an input voltage of 120 V or 277 V even with the selection of the inductors L1, L2 for a circuit arrangement in accordance with FIG. 1 and dimensioning for 120 V or 277 V in accordance with the prior art.

The invention claimed is:

1. A circuit arrangement for dimming at least one lamp, comprising:

a connection for a supply voltage ($U_e$);

a dimming device (10) that is connected on the input side to the connection for the supply voltage ($U_e$) and has an input (8) for a dimming selection and at least one switch; and a filter device (12) that is connected to the output of the dimming device (10), the filter device (12) having at least one capacitor (C1; C2) and an output for coupling to an electronic ballast;

characterized in that it also has an input impedance modification device (18) that is connected to the filter device (12) and is designed to modify the input impedance active at the input of the filter device (12).

2. The circuit arrangement as claimed in claim 1, characterized in that at least one switch of the dimming device (10) is a triac or a thyristor.

3. The circuit arrangement as claimed in claim 1, characterized in that the input impedance modification device (18) is designed to modify the capacitive component of the input impedance.

4. The circuit arrangement as claimed in claim 3, characterized in that the input impedance modification device (18) is designed to switch at least one further capacitor (C4) in parallel or series with the at least one capacitor (C2) of the filter device (12).

5. The circuit arrangement as claimed in claim 1, characterized in that the input impedance modification device (18) is designed to modify the input impedance active at the input of the filter device (12) as a function of the supply voltage ($U_e$), in particular of the amplitude of the supply voltage.

6. The circuit arrangement as claimed in claim 5, characterized in that the input impedance modification device (18) has an input (20) that is connected to a signal that is correlated with the supply voltage ($U_e$).

7. The circuit arrangement as claimed in claim 1, characterized in that the filter device (12) comprises a rectifier circuit (14).

8. A method for dimming at least one lamp in the case of which a signal to a filter device (12) is provided with the aid of a dimming device (10) that is connected to a supply voltage ($U_e$), and wherein the filter device (12) has at least one capacitor (C1; C2) and an output for coupling to an electronic ballast for the lamp, characterized in that the input impedance active at the input of the filter device (12) is modified as a function of the supply voltage ($U_e$).

9. The circuit arrangement as claimed in claim 2, characterized in that the input impedance modification device (18) is designed to modify the capacitive component of the input impedance.

10. The circuit arrangement as claimed in claim 9, characterized in that the input impedance modification device (18) is designed to switch at least one further capacitor (C4) in parallel or series with the at least one capacitor (C2) of the filter device (12).

* * * * *